US006290242B1

(12) United States Patent
Ludwig

(10) Patent No.: US 6,290,242 B1
(45) Date of Patent: Sep. 18, 2001

(54) DOUBLE-ACTION INLINE SKATE WITH WHEEL SURFACE SHAPED FOR MANEUVERABILITY

(76) Inventor: Edward Eugene Ludwig, 40 Drake St., Yarmouthport, MA (US) 02675

( * ) Notice: Subject to any disclaimer, the term of this patent is extended or adjusted under 35 U.S.C. 154(b) by 0 days.

(21) Appl. No.: 09/669,341

(22) Filed: Sep. 26, 2000

(51) Int. Cl.[7] ..... A63C 17/04; A63C 17/22

(52) U.S. Cl. ..... 280/11.233; 301/5.3

(58) Field of Search ..... 280/11.19, 11.221, 280/11.223, 11.227, 11.27, 11.28, 87.042, 842, 11.233, 11.24, 11.25; 301/5.3, 5.7

(56) References Cited

U.S. PATENT DOCUMENTS

| | | | | |
|---|---|---|---|---|
| 282,156 | * | 7/1883 | Burton | 280/11.223 |
| D. 292,729 | * | 11/1987 | Ludwig | D21/226 |
| 622,391 | * | 4/1899 | Rankin et al. | 301/5.3 |
| 1,294,984 | * | 2/1919 | Ware | 280/11.19 |
| 1,489,197 | * | 4/1924 | Daverkosen et al. | 280/11.19 |
| 1,542,103 | * | 6/1925 | Shoemaker | 301/5.3 |
| 2,964,778 | * | 12/1960 | Frey | 16/21 |
| 3,282,598 | * | 11/1966 | Goodwin | 280/11.22 |
| 3,355,185 | * | 11/1967 | Carter | 280/11.23 |
| 3,693,988 | * | 9/1972 | Steinhiser | 280/11.23 |
| 4,047,727 | * | 9/1977 | Holladay et al. | 280/87.041 |
| 4,138,127 | * | 2/1979 | Kimmell et al. | 280/11.23 |
| 4,298,209 | * | 11/1981 | Peters | 280/11.2 |
| 4,373,736 | * | 2/1983 | Stumbaugh | 280/11.23 |
| 4,844,492 | * | 7/1989 | Ludwig | 280/11.23 |
| 5,029,882 | * | 7/1991 | Marandel | 280/11.2 |
| 5,114,166 | * | 5/1992 | McCosker | 280/87.042 |
| 5,411,320 | * | 5/1995 | Alderman et al. | 301/5.3 |
| 5,573,309 | * | 11/1996 | Bekessy | 301/5.3 |
| 5,690,395 | * | 11/1997 | Hicks | 301/105.1 |

FOREIGN PATENT DOCUMENTS

| | | | | |
|---|---|---|---|---|
| 202577 | * | 4/1939 | (CH) | 280/11.19 |
| 433586 | * | 4/1948 | (IT) | 280/11.23 |
| 52-24738 | * | 2/1977 | (JP) | 280/842 |
| 5237212 | * | 9/1993 | (JP) | 280/11.25 |

* cited by examiner

*Primary Examiner*—Brian L. Johnson
*Assistant Examiner*—G. B. Klebe

(57) ABSTRACT

A two-wheel inline skate is disclosed having double-action turning means and dual surfaced wheel rollers providing maneuverability, traction, control, and safety in executing turns. The rollers have a two-point stance providing increased leverage and turning force, and are in combination with double-action wheel hangers. The double-action hanger mechanism incorporates elements of a kingbolt platform, a pivot post and a roller-supporting bracket, all emanating from a central hanger crossmember located directly over the roller. The entire hanger frame may be cast in one piece thus constituting a unified and strong hanger for the transmission of turning forces in operating the double-action mechanism. The traction surfaces of the wheels have an arcuately shaped central running part in combination with frusto-conically surfaced end parts of decreasing diameter, where the angle of taper of the conical parts equals the angle of inclination of the central running part surface occurring at the bounds of the central running surface and where the ends of the central section are connected to the respective conical end parts by means of a concave elliptical surface.

2 Claims, 2 Drawing Sheets

DOUBLE-ACTION INLINE SKATE WITH WHEEL SURFACE SHAPED FOR MANEUVERABILITY

BACKGROUND OF THE INVENTION

This invention relates to the art of the two-wheel skate when employing the use of certain dual surfaced rollers in combination with double-action turning means. Essentially, each roller has an arcuately shaped central section providing the skater a certain degree of lateral roller mobility while skating in a generally forward direction, and frusto-conical end sections providing the lateral roller stability needed by the skater in applying pressure to the turning mechanisms, thus providing a two-wheel skate with the mechanical means to accomplish double-action turns.

Such a skate was first presented to the roller skating art by this applicant in U.S. Pat. No. 4,844,492 issued Jul. 4, 1989. At that time, and in association with a roller skate manufacturer, the first industrial prototype of the skate was produced.

During the intervening years improvements in the skate have focused on three basic needs: first, reducing the roller's lateral width to more practical proportions without sacrificing turning function, second, unifying and strengthening the design of the double-action turning mechanism, and third, integrating all the component elements of the skate in a manner and style more in keeping with current standards in roller skating art.

SUMMARY OF THE INVENTION

It is an object of this invention to provide increased turning efficiency and improved maneuverability in a two-wheel inline skate by the employment of improved rollers in combination with an improved structural design of the double-action turning mechanisms.

It is a further object of this invention to provide a general purpose two-wheel inline skate that is well crafted and styled, suitable for indoor and outdoor use on normal skating surfaces, practical in respect to manufacturing means and lightweight materials, and which provides improved maneuverability with superior traction, control and safety in the execution of turns.

This invention provides certain improvements in mechanical efficiency, operation and performance ability of a two-wheel inline skate by the employment of improved rollers having a unique two-point stance providing increased leverage potential and increased turning force, in combination with an improved structural design of the double-action hanger means providing a more efficient framework for the transmission of turning forces.

The improved structural design of the double-action hanger mechanism provides a new and improved hanger means in which the three major hanger elements, comprising the kingbolt platform, pivot post and roller-supporting brackets, all emanate from the central hanger crossmember located directly over the roller, and wherein the entire hanger frame may be cast in one piece of high strength, lightweight material, thus constituting a more unified and stronger hanger means for the transmission of turning forces in operating the double-action mechanism.

The roller of the instant invention retains the same basic components as the original roller of U.S. Pat. No. 4,844,492 cited above, that is, an arcuately surfaced central part in combination with conically surfaced end parts, but introduces new features in respect to the manner of integrating the combined surfaces. Additionally, the new roller has a greatly reduced lateral width providing the roller with more practical overall proportions and contributing directly to a more compact and stronger roller/hanger assembly.

The method of integrating the combined surfaces of the improved roller provides for the employment of an arcuately shaped central section which has a smaller central running surface defined thereon, and relatively narrow frusto-conical end parts of decreasing diameter located a short distance away from the central section, and wherein the angle of taper of the end parts equals the angle of inclination occurring at the respective bounds of the central running surface, with said angle of taper also being on a plane coinciding with said respective bounds, and wherein the ends of the central section are connected to the respective conical end parts by means of a concave elliptical surface.

In the course of normal operation and under right or left lateral pressure of the skater in executing turns, the improved roller described above naturally adopts a two-point stance in spanning the recessed surface area between the right or left bound of the central running surface and the respective conical end part. This two-point stance effectively provides an extended conically-oriented running surface almost three times wider than the actual conical end part, thus providing the roller ample lateral stability for the skater to work with in the application of turning pressure, while at the same time providing for a much higher concentration of turning force on the narrow conical end part where the roller's leverage potential is greatest and where the concentrated turning force can be used to a proportionate and improved mechanical advantage, thereby increasing the mechanical efficiency of the roller as well as the combined roller/hanger assembly and contributing directly to improved maneuverability of the skate.

The roller's central running surface provides for skating motion in a generally forward direction and also allows for unimpeded mobility in lateral inclination throughout the range of lateral curvature in the central running surface, thus enabling the skater to shift his or her balance point, as need or desire dictates, to any point within said range.

The operational features, thus described, provide the basis of the roller's improved surface design in this method of roller construction and also establish the central running surface as the controlling element effecting surface configuration and related roller function. An increase in the degrees of arc on the central running surface would provide increased skating mobility on the central part with a proportionately slower response in turning function. Decreasing the degrees of arc reverses the equation. Small variations in this respect could find useful application in the design of specialized rollers for different age groups, skill levels and activities.

Of equal importance to the skate's maneuverability is the added traction and control in turns resulting from the frictional contact of the conical end parts. This improved traction, together with the angular orientation of the conical contact, permits the skater to lean into turns in a more natural skating style and provides substantially more control and safety in turns than is found in conventional inline roller skates.

DESCRIPTION OF THE PREFERRED EMBODIMENT

Figure 1:
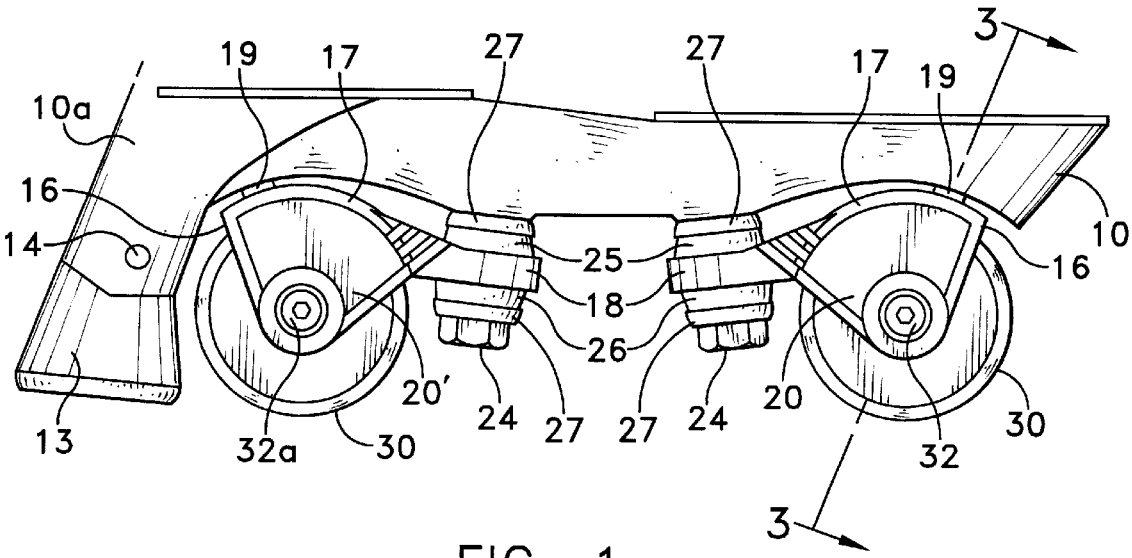
FIG. 1 is a side elevation of an inline roller skate constructed in accordance with the invention.

With reference to FIG. 1, 10 illustrates the supporting plate of the roller skate which is fastened to a skate shoe or boot in any suitable manner (not shown). On the back end of the supporting plate is a brake element 13 which is inserted into an aperture in the downward sloping arm 10*a* of the supporting plate 10 and secured by bolt 14. Attached to the supporting plate are a pair of rollers and, for convenience, only one roller structure will be described. Each roller has a hanger means 16, said hanger means being more precisely a double-action hanger means having a unified frame cast in one piece and comprising therein a central hanger crossmember 17, the kingbolt platform 18, a pivot post 19 and a pair of roller-supporting brackets 20, 20'. The pivot post 19 is adapted for insertion into a pivot post socket such as 21 (see FIG. 4) on the supporting plate 10 with a resilient cushion 19*a*. The platform 18 is provided with an aperture therein that receives the kingbolt 24, the bolt 24 having a tapered cushion 25 thereon, which cushion is made in two parts, there being also a lower part 26, with each cushion having a retaining cap 27, and wherein the completed kingbolt assembly is stabilized by securing the kingbolt 24 to a threaded socket (not shown) in the supporting plate 10 and tightening said bolt 24 until the desired tension is obtained in the cushioned assembly. The arrangement is such, as is well known to those skilled in the art, that the platform 18 is essentially supported by the resilient cushions and with the pivot post 19 also supporting the hanger, the two cooperate so that angular displacement of the roller/hanger assembly may be had.

Figure 4:
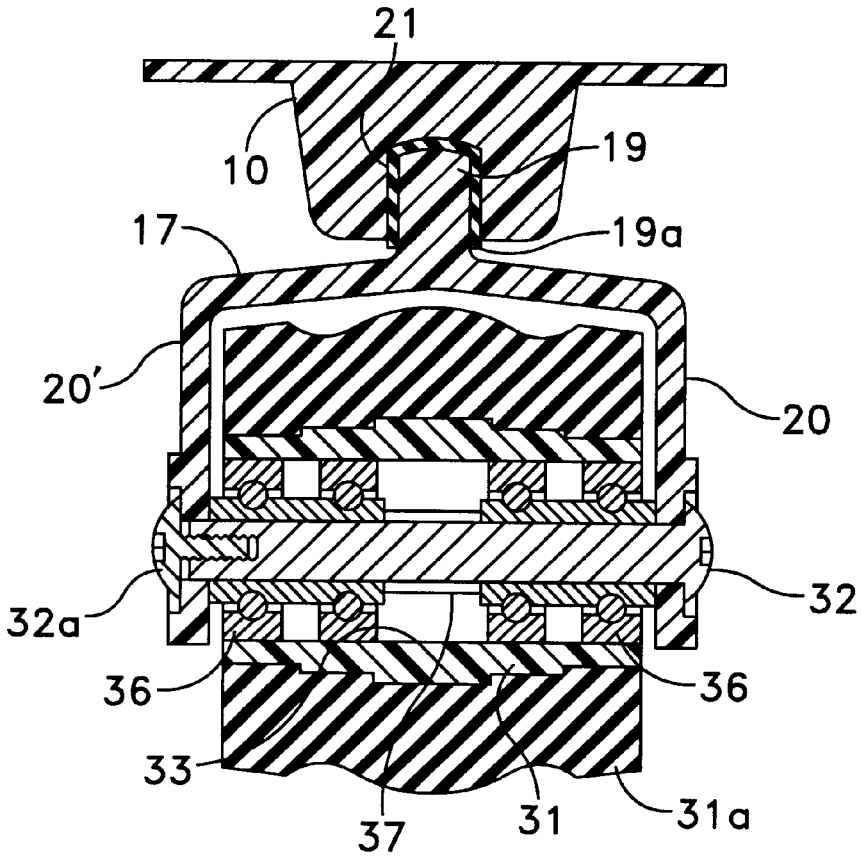
FIG. 4 is a sectional view of the supporting plate, hanger and roller assembly taken on lines 3—3 of FIG. 1.
Figure 5:
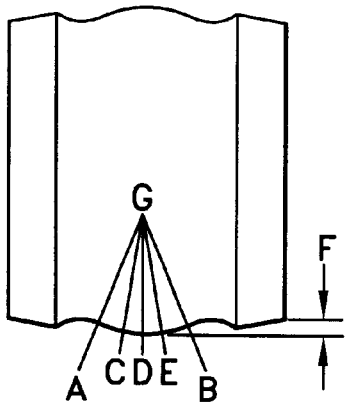
FIG. 5 is a diagrammatic view showing the development of the surface of the roller.

Mounted on the hanger means 16 by an axle bolt 32 is the roller 30 of the instant invention (see FIG. 4). Said axle bolt 32 has a threaded socket on one end for receiving the axle retaining bolt 32*a*. The roller 30 is constructed in two parts, there being an internal part in the form of a rigid core element 31 having a cylindrical aperture 33 into which anti-friction bearings 36 and bearing spacer 37 may be received. The outer surface 31*a* of the roller is polyurethane for good wearing ability and is cast about the core element. As seen in FIG. 5 of the drawings, the roller that is there illustrated employs a maximum diameter of 58 mm and a lateral width of 50 mm. The surface of the central part of the roller is formed by the arc A-B having 50 degrees of curvature centered on the roller's midpoint with a radius of 17.5 mm, and employing thereon a smaller central running surface C-E of 14 degrees, comprising right and left inclinations of 7 degrees each. Extending from each end of the central part A-B is a concave elliptical surface connecting to the respective frusto-conical end part. In the example given, the surface of each conic section equals 8 mm. Essentially, there is an arcuate central running surface integrated with conically surfaced end parts and the conical end parts have their surfaces defined to the central axis at an angle that is equal to the angle of arc C-D, thus, arc C-D equals angle F and arc D-E equals angle F. Additionally, the conical surface of each end part is aligned on a plane coinciding with the respective right or left bound of the central running surface.

All of the component elements of the skate thus described can be manufactured from suitably strong, lightweight plastic material with the exception of the axle bolts, bearing assemblies, brake retaining bolt and the kingbolt cushion retaining caps.

Figure 2:
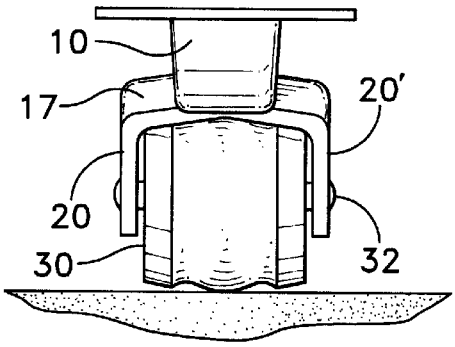
FIG. 2 is a front elevation of the skate shown with the roller in an upright position.

The compact, integrated design of the double-action hanger means is illustrated by the various views in FIGS. 1, 2 and 4. Worthy of special mention is the central hanger crossmember 17 which serves as the main unifying element of the hanger frame and whose structural strength is enhanced by its form being arched both longitudinally and laterally.

While the hanger means is particularly designed to have the structural integrity needed to withstand the stresses of the double-action turning function it is also evident that, subject to the weight and movements of the skater as well as the irregularities encountered in normal skating surfaces, there will be a resulting small degree of flex in the central hanger crossmember directly under the pivot post support. This small degree of flex should act as a natural shock absorber for the pivot post which, together with the cushioned kingbolt assembly, provides the skate with a unique potential for achieving exceptional riding comfort.

FIG. 2 of the drawings shows the roller of the instant invention in an upright position illustrating an embodiment wherein the integrated surfaces provide a moderate 14 degrees of lateral mobility on the central running surface in combination with a rather quick turning response of 7 degrees right or left inclination. It can also be seen, accordingly, that an increase in the degrees of arc on the central running surface to 20 degrees would extend the skater's lateral mobility on the central part while providing a proportionately slower turning response of 10 degrees right or left inclination. Decreasing the degrees of arc reverses the equation.

Figure 3:
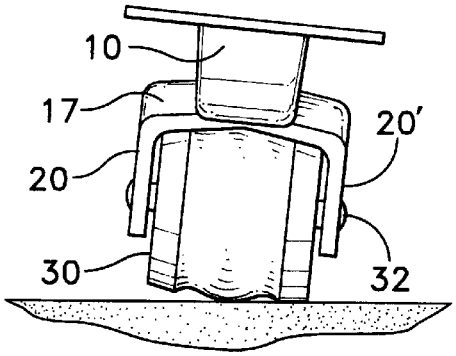
FIG. 3 is a front elevation of the skate shown with the roller in a fully inclined position.

FIG. 3 of the drawings shows the roller in a fully inclined position illustrating the roller's two-point stance and the resulting increased frictional contact with the ground surface in turning maneuvers. As can be seen, the two-point stance provides the roller with ample lateral stability and at the same time provides for an increased concentration of turning force on the narrow conical end parts, thereby increasing the mechanical efficiency of the roller and contributing directly to improved operational efficiency of the combined roller/hanger means and improved maneuverability of the skate.

The roller's increased frictional contact with the ground surface while in a fully inclined position provides added traction and control in turning maneuvers which, together with the angular orientation of the conical contact, allows the skater to lean into turns in a more natural style, thus providing substantially more control and safety in turns than is evident in conventional inline roller skates.

Essentially, the roller skate is designed for general recreational use by all age groups and provides improved maneuverability with increased traction, control and safety in executing turns.

I claim:

1. A roller skating device comprising in combination with a supporting plate for engagement to a skate shoe or boot, and a pair of longitudinally spaced roller wheel assemblies, each wheel assembly comprising a double-action hanger means having roller-supporting brackets, a pivot post and resilient mounting means for pivotally attaching each hanger to said supporting plate, and a unitary roller rotatably secured to each of said brackets, each roller having a central section and right and left frustro-conical end sections of decreasing diameter, the central section employing a transversely curved surface which has a smaller central running surface defined thereon, and a concave elliptical surface extending from each end of said central section and connecting to a right and left frusto-conical end sections of decreasing diameter, and wherein the angle of taper of each conical end part, as measured from a line extending parallel to the axis of the roller, is equal to the angle of inclination occurring at the bounds of said central running surface, and wherein said angle of taper of each conical end part is aligned on a plane coinciding with the respective bounds of said central running surface.

2. The roller of claim 1 employed in a roller skating device having two or more rollers.

* * * * *